US011634954B2

(12) United States Patent
Jordan et al.

(10) Patent No.: US 11,634,954 B2
(45) Date of Patent: Apr. 25, 2023

(54) SURGE REDUCTION SYSTEM FOR RUNNING LINER CASING IN MANAGED PRESSURE DRILLING WELLS

(71) Applicant: Frank's International, LLC, Houston, TX (US)

(72) Inventors: John Christopher Jordan, Spring, TX (US); Joseph Jude Boudreaux, Schriever, LA (US); Roland Taylor Hennigan, Huffman, TX (US); Tony Wooley, Conroe, TX (US); Keith Thomas Lutgring, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 16/845,709

(22) Filed: Apr. 10, 2020

(65) Prior Publication Data

US 2021/0317711 A1 Oct. 14, 2021

(51) Int. Cl.

| | |
|---|---|
| ***E21B 21/08*** | (2006.01) |
| ***E21B 21/10*** | (2006.01) |
| ***E21B 33/14*** | (2006.01) |
| ***E21B 33/16*** | (2006.01) |
| ***E21B 34/06*** | (2006.01) |

(52) U.S. Cl.

CPC ..... *E21B 21/08* (2013.01); *E21B 21/103* (2013.01); *E21B 33/14* (2013.01); *E21B 33/16* (2013.01); *E21B 34/063* (2013.01); *E21B 2200/04* (2020.05); *E21B 2200/05* (2020.05)

(58) Field of Classification Search

CPC ..... E21B 21/08; E21B 34/063; E21B 33/16; E21B 33/14; E21B 21/103; E21B 2200/04; E21B 2200/05; E21B 43/10; E21B 33/04

See application file for complete search history.

(56) References Cited

U.S. PATENT DOCUMENTS 3,957,114 A * 5/1976 Streich ..... E21B 21/10 166/285
4,582,140 A * 4/1986 Barrington ..... E21B 49/088 166/334.2

(Continued)

OTHER PUBLICATIONS

Extended European Search Report dated Aug. 10, 2021, EP Application No. 21164718, 12 pages.

*Primary Examiner* — Michael R Wills, III
(74) *Attorney, Agent, or Firm* — MH2 TECHNOLOGY LAW GROUP LLP

(57) ABSTRACT

A system for controlling surge pressure and deployed into a wellbore drilled using a managed pressure drilling technique includes auto-fill float equipment allowing flow into a liner casing string, a drillpipe diverter providing a flow path between a drillpipe landing string and an annulus, and a drillpipe flow restrictor selectively blocking the flow path from the top of the drillpipe landing string while allowing fluid to be displaced up the liner casing string and into the annulus. The drillpipe flow restrictor and the drillpipe diverter are convertible to provide a flow path from the wellbore through the auto-fill float equipment to a top surface while blocking flow through the diverter into the annulus. The auto-fill float equipment is convertible to block the flow path from the wellbore into the liner casing string, while allowing fluid to flow from the liner casing string into the wellbore.

3 Claims, 7 Drawing Sheets

(56) References Cited

U.S. PATENT DOCUMENTS

| | | | | |
|---|---|---|---|---|
| 5,960,881 | A | 10/1999 | Allamon et al. | |
| 6,920,930 | B2 * | 7/2005 | Allamon | E21B 23/04 166/318 |
| 7,318,478 | B2 * | 1/2008 | Royer | E21B 34/14 166/332.4 |
| 9,255,466 | B2 * | 2/2016 | Javed | E21B 43/10 |
| 9,835,008 | B2 * | 12/2017 | Rogers | E21B 34/00 |
| 2001/0045288 | A1 | 11/2001 | Allamon et al. | |
| 2002/0144813 | A1 | 10/2002 | Allamon et al. | |
| 2006/0011354 | A1 * | 1/2006 | Logiudice | E21B 21/103 166/380 |
| 2011/0036588 | A1 * | 2/2011 | Heironimus | E21B 21/001 166/345 |
| 2012/0018172 | A1 * | 1/2012 | Javed | E21B 43/10 166/382 |
| 2015/0330186 | A1 * | 11/2015 | Budde | E21B 34/12 166/373 |
| 2018/0238460 | A1 * | 8/2018 | Mericas | E21B 21/10 |
| 2020/0232302 | A1 * | 7/2020 | Budde | E21B 23/04 |

* cited by examiner

SURGE REDUCTION SYSTEM FOR RUNNING LINER CASING IN MANAGED PRESSURE DRILLING WELLS

BACKGROUND

In the oil and gas industry, Managed Pressure Drilling ("MPD") is an adaptive drilling method to maintain annular pressure throughout the wellbore. Managed pressure drilling ("MPD") overcomes drilling problems like mud losses, non-productive time for curing mud losses, etc., by managing surface pressure to maintain a downhole pressure exerted by drilling fluids. The downhole hydrostatic fluid pressure exerted by the column of drilling fluid in a wellbore prevents the flow of formation fluids into the wellbore. The downhole hydrostatic pressure is controlled so as to maintain the downhole pressure below the fracture initiation pressure of the formation. This is accomplished through the use of a closed-loop drilling fluids control system to artificially control the downhole pressure within the wellbore by creating and controlling the fluid pressure at the surface. One component of the closed-loop drilling system is the rotating control device (RCD). RCDs create a closed-loop environment by sealing off the annulus between the outside diameter (OD) of a tubular string suspended within the wellbore and the inside diameter (ID) of the drilling riser to contain and divert fluids and to enable wellbore pressure management. The RCD is connected to the drilling fluids control equipment on the rig via a surface backpressure line that applies downhole pressure to the system while the return line to the MPD choke allows fluid to be removed from the well under controlled pressure.

When drilling a well using MPD systems, casing running operations can introduce a particular problem that is not as prominent with wells that are drilled using conventional drilling system (non-MPD systems). The problem is the creation of surge pressure when the casing string is being lowered downhole. The surge pressure comes as a result of the close fit between the outside diameter (OD) of the casing being run and the inside diameter (ID) of the wellbore that the casing is being run into. Surge pressure that is greater than the fracture initiation pressure of the formation can result in a fracturing of the formation, which in turn leads to mud flowing into the formations rather than being contained within the wellbore, and thus a system for reducing surge pressure on the formation is needed. This is particularly true when running liner casing strings that are run into the bottom section of a typical oil or gas well where the ID of the wellbore is at its minimum and thus the fit between the OD of the liner casing and the ID of the wellbore is particularly close.

Prior to the widespread use of MPD techniques and systems, some surge reduction tools were developed that were effective in reducing surge pressure in wells drilled with conventional (non-MPD) drilling systems. These various surge reduction tools were useful when applied to MPD drilling systems but alone were inadequate to both reduce surge pressure and maintain control of surface pressure in the wellbore at all times during casing running operations. A system that reduces surge pressure to the point of nearly eliminating it while also maintaining control of surface pressure increases the probability of running liner casing strings to bottom of the wellbore without fracturing the formation.

Surge reduction tools that were developed prior to the introduction of MPD systems included auto-fill float equipment and ported drillpipe diverter tools. The combination of these tools create a flow path to the surface that reduces surge pressure by allowing the fluid being displaced by lowering the casing string to flow up through the large ID of the casing string up to the ported drillpipe diverter and out of the diverter into the annulus between the drillpipe and the ID of the previously run casing string rather than through the small annular area between the OD of the liner casing and the wellbore ID.

As shown in FIG. 7A, surge pressure is generated as a result of "piston effect" while running casing into tight annular space. Surge pressure may overcome the pore pressure of the formation, fracturing the formation and causing mud losses into the formation. Auto-fill float equipment (14) shown in FIG. 7B allows fluid to enter the casing unobstructed through the float shoe (26) and float collar (27) located at the bottom of the string being run and thus provides alternate path for displaced fluid instead of the small annulus between the liner casing OD and wellbore ID or ID of previously run casing. Once the casing string is landed in the wellbore and is to be cemented in place, the collar (27) and/or shoe (26) are converted to actuate a flapper valve type device (not shown in figure) typically by dropping a ball or dart from the surface which lands in a seat and mechanically shifts components in the float equipment to release a spring actuated flapper valve. Once released, the flapper valve functions as a check valve during cementing operations by not allowing fluid pressure communication and flow up the interior of the liner casing string.

Surge reduction diverters allow fluid traveling up the ID of the casing string to exit into the annulus just above the casing hanger instead of having to force the fluid up the restricted drillpipe ID all the way to surface. Allowing the fluid to exit the interior of the drillpipe into the annulus reduces the magnitude of the surge pressure that is created when the casing string is lowered downhole. One version of the drillpipe diverter discussed and described in U.S. Pat. Nos. 6,390,200, 6,467,546, 6,520,257, 6,695,066, and 6,769,490, which are incorporated herein by reference to the extent not inconsistent with the present disclosure. The diverter allows fluid flow up the interior of the tool as well as laterally through the ports to the annulus, providing two flow paths for fluid being displaced during casing or liner running operations.

When applying industry standard surge reduction diverters in wells being drilled with MPD technology, the fluid is allowed to flow through the diverter ports into the annulus and also vertically up through the drillpipe string to the surface. Allowing drilling fluid to escape from the interior of the drill string for even brief periods of time is problematic. Drilling fluid escaping from the top of the drill string results in well control problems and rig floor cleanliness issues and compromises the MPD system by allowing pressurized fluid (intended to maintain downhole pressure) to flow up to the surface unobstructed.

The flow restrictor can take on multiple forms but can be broadly characterized as a device such as a valve that can initially block the ID of the drillpipe so as to prevent the passage of fluid through the device and thus maintain the desired pressure within the pipe and wellbore, generally while the liner casing string is being lowered downhole. At a desired point in the process the flow restrictor can be actuated to open up the through bore of the drillpipe so as to allow fluid, cement darts and cement to be pumped downward through the device.

The first alternative for flow restrictor is a ball valve that can be run in the string in the closed state but can selectively be actuated from the closed or blocked position to the open position to allow fluid through the ID of the drillpipe, an example of which is the DIS Sentinel valve or a BlackHawk Modified Storm Valve.

A second alternative to a flow restrictor or a selectively openable valve is a rupture disc type device. The rupture disc type device consists of a housing that contains a disc that is secured in place and blocks the flow path through the device. The rupture disc is calibrated to rupture at a predetermined pressure so similar to a valve that can respond to a pressure signal to shift to the open position the rupture disc ruptures open in response to a pressure signal to open up the flow path through the device. Examples of this type of rupture disk sub include the Frank's Circulation Actuated Flow Control Tool (C.A.T.)

A third alternative can be described as a disappearing glass sub or buoyancy sub. These devices consist of a housing that contains a ceramic or glass disc or dome that is secured in place and blocks the flow path through the device. The ceramic/glass structure is designed to rupture at a predetermined pressure so similar to a valve that can respond to a pressure or other signal to shift to the open position. The ceramic/glass disc concept ruptures open in response to a pressure or other signal to open up the flow path through the device. Examples of this type of rupture disk sub are BlackHawk Casing Flotation Sub, NCS Air Lock Buoyancy Sub, Nine Energy Service Casing Flotation Sub and Halliburton BACE Buoyancy Assisted Casing Equipment Sub.

A fourth alternative to a flow restrictor is a flapper-type check valve type device that consists of a housing that contains a full-open flapper valve that is secured into a sub to block the upward flow path through the device. The flapper is spring biased upward to the blocked position thus causing the flapper valve to function as a spring loaded check valve. When the liner is set in position at predetermined depth in the wellbore, flow and pressure from the surface causes the flapper to open thus creating an open flow path downward through the device.

A fifth alternative is a check valve type device that consists of a housing that contains a buoyant first ball that is secured in place both above and below the ball using extrudable seats to block the flow path thru the device. When the liner casing string is set at the predetermined depth, a second ball can be dropped from surface to extrude the upper seat and push the first ball through a lower extrudable seat to open the flow path through the device. The second ball then lands on the extrudable seat in the diverter which actuates the diverter ports into the closed position.

The diverter allows fluid in the interior of the liner casing string to flow outward through the opened ports of the diverter into the annulus between the interior of the previously run casing string and the exterior of the drillpipe landing string as the liner casing string is lowered into the wellbore. At the appropriate step in the method, the diverter ports can be blocked typically by dropping a ball or dart from the surface to shift a sleeve within the diverter. Blocking the ports prevents fluid passage from the interior of the drill pipe landing string to the annulus.

There is a need for an improved liner casing running system and method for better well control, surge pressure reduction and clean operation when using Managed Pressure techniques and systems.

SUMMARY

A system for controlling surge pressure, assembled onto a liner casing string and a drillpipe landing string to be deployed into an oil or gas wellbore that is being drilled using a managed pressure drilling technique is disclosed. The system includes auto-fill float equipment coupled to a lower end of the liner casing string and configured to allow fluid flow from the wellbore into the liner casing string as the string is lowered, a drillpipe diverter attached to the drill pipe landing string and comprising ports that, when open, provide a fluid flow path between an interior of the drillpipe string and an annulus defined between the drillpipe landing string and the wellbore, and a drillpipe flow restrictor attached to the drill pipe landing string above the diverter and configured to selectively block the flow path from the top of the drill pipe landing string while allowing fluid in the wellbore to be displaced up an interior of the liner casing string, through the ports of the diverter, and into the annulus defined between the drillpipe landing string and the wellbore. The drillpipe flow restrictor and the drillpipe diverter are convertible to provide a fluid flow path from the wellbore through the auto-fill float equipment of the liner casing string to a top surface while blocking flow through the diverter ports into the annulus. The auto-fill float equipment is convertible to block fluid flow path from the wellbore into the liner casing string, while allowing fluid to flow from the liner casing string into the wellbore.

A method of controlling surge pressure when installing a liner casing string into a wellbore that is drilled using a managed pressure drilling technique is also disclosed. The method includes attaching auto-fill float equipment to a lower end of a liner casing string, assembling the liner casing string, connecting a liner hanger to a top end of the liner casing string, connecting a drill pipe landing string above the liner hanger via a crossover connection wherein the drillpipe landing string includes diverter, with diverter ports open located in the lower portion of the string and a flow restrictor in a closed position in the drill pipe landing string, above the diverter, lowering the liner casing string into the well to a desired depth, while allowing displaced fluid to flow up through the auto-fill float equipment through an interior of liner casing string and through the diverter to an annulus between an exterior of the drillpipe string and the wellbore. Fluid flow up the interior of the drillpipe string above the diverter is blocked by the flow restrictor. The method also includes establishing a connection between the drillpipe string and a top drive, actuating the flow restrictor, into an open position, allowing fluid to flow from the top drive through the drill pipe landing string and liner casing, actuating the diverter, to close the diverter ports thereby allowing fluid to be pumped from the top drive through the drillpipe landing string and liner casing string. Fluid is prevented from flowing out of the diverter. The method also includes actuating the auto-fill float equipment to prevent fluid from flowing from the wellbore into the liner casing, pumping drilling fluid from the top drive through the drillpipe string and liner casing string, cementing the liner casing in place wherein cementing includes launching a first cement plug and pumping cement through the drillpipe landing string and liner casing string, and pumping drilling fluid to displace cement into an annulus surrounding the liner casing string.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
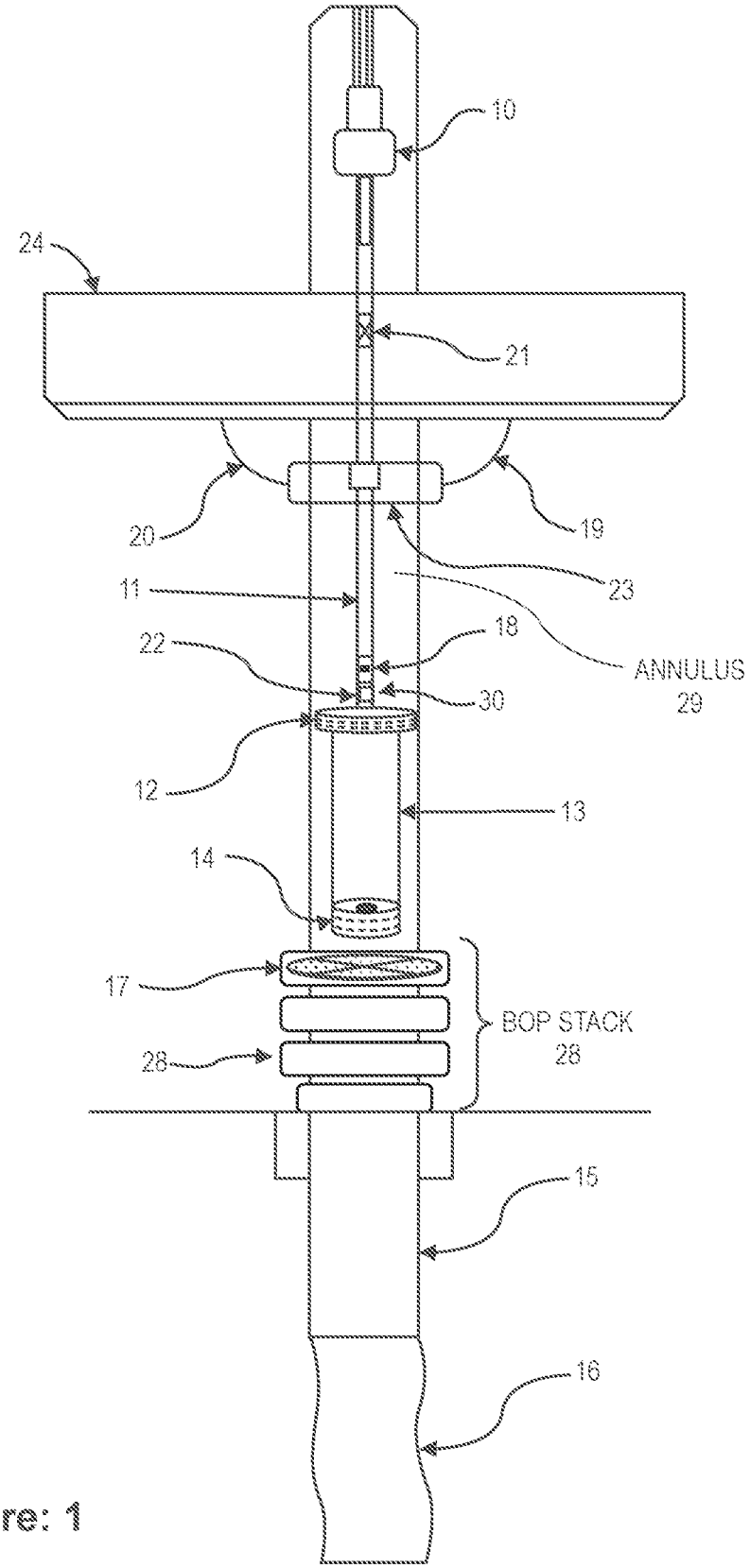
FIG. 1 illustrates a system of components for liner casing string running according to an embodiment.

It should be noted that some details of the figure have been simplified and are drawn to facilitate understanding of the embodiments rather than to maintain strict structural accuracy, detail, and scale.

DETAILED DESCRIPTION

The following are systems and methods for controlling surge pressure while maintaining well control and rig floor cleanliness, while running liner casing in the wellbore that is being drilled using Managed Pressure Drilling techniques and systems.

The liner casing running system of the present invention includes a system of components that are assembled onto the liner casing string to be deployed into wellbore that is being drilled using MPD techniques and systems. Furthermore, the system of components includes a combination of devices that are commonly used to reduce surge pressure when running liner casing strings that are being run into wellbores that are being drilled with conventional (non-MPD) techniques and systems. The devices used for reducing surge pressure on non-MPD wells are auto-fill convertible float equipment and surge reduction diverters. Additionally, a flow restrictor is provided above the diverter which, in closed state, blocks off the interior of the drillpipe string thus preventing fluid flow up the interior of the drillpipe but at the appropriate step in the liner casing running sequence can be opened to allow cementing operations which requires pumping cement downhole to take place.

The flow restrictor according an embodiment may include a ball valve that can be run in the string in the closed state but can selectively be actuated from the closed or blocked position to the open position to allow fluid through the ID of the drillpipe. In an alternative embodiment, the flow restrictor may include a rupture disc type device that is calibrated to rupture at a predetermined pressure to open up the flow path through the device. In yet another alternative embodiment, the flow restrictor may include a disappearing glass sub or buoyancy sub consisting of the ceramic/glass structure that is designed to rupture at a predetermined pressure to open up the flow path through the device. In yet another alternative embodiment, the flow restrictor may include a flapper-type check valve type device which is spring biased upward into the blocked position and when the liner is set in position at predetermined depth in the wellbore, flow and pressure from the surface causes the flapper to open thus creating an open flow path downward through the device. In yet another alternative embodiment, the flow restrictor may include a check valve type device that consists of a housing that contains a buoyant first ball that is secured in place both above and below the ball using extrudable seats to block the flow path thru the device. When the liner casing string is set at the predetermined depth, a second ball can be dropped from surface to extrude the upper seat and push the first ball through a lower extrudable seat to open the flow path through the device. The second ball then lands on the extrudable seat in the diverter which actuates the diverter ports into the closed position.

When using "Managed Pressure Drilling" (MPD) technology, the fluid pressure in the annulus is mechanically maintained at a slightly higher pressure than the interior of the drillpipe in the wellbore. Therefore when running liner casing strings into wells of this type with surge reduction auto-fill float equipment and surge reduction diverters, the pressure differential between the exterior of the drillpipe and the interior of the drillpipe results in fluid being pushed through the drill pipe diverter up the interior of the drillpipe to the surface unless a mechanical barrier such as a flow restrictor is placed in the drillpipe. Placing the flow restrictor in the drillpipe string blocks passage of fluid up the drillpipe string to the surface. To compensate for blocking the interior of the drillpipe, the diverter provides a path for displaced fluid to escape from the interior of the drillpipe to the annulus thus keeping the surge pressure from exceeding the fracture initiation pressure of the formation while the liner casing is being lowered into the wellbore.

In another aspect, a method is provided to run liner casing strings into wellbores that are being drilled using Managed Pressure Drilling techniques and systems. The method employs a combination of devices that are used to reduce surge pressure while maintaining well control and rig cleanliness when running liner casing strings into wellbores that are being drilled with conventional (non-MPD) techniques and systems. The devices used for reducing surge pressure on non-MPD wells are auto-fill convertible float equipment and surge reduction diverters. This method utilizes the flow restrictor or flow restrictor in combination with the auto-fill convertible float equipment and surge reduction diverter to provide a means and a method for reducing surge pressure while maintaining control of wellbore pressure when running liner casing strings into wellbores being drilled with MPD techniques and systems.

In yet another aspect, the method of controlling surge pressure when installing liner casing strings into a wellbore that is drilled using managed pressure drilling techniques and systems, includes lowering the assembled string into the wellbore with the system configured to allow displaced fluid to flow up through the interior of the drillpipe string through a drillpipe diverter to the annulus between the exterior of the drillpipe landing string and the interior of the wellbore while blocking fluid flow up through the drillpipe string. The method also includes converting components in the system once the liner casing string is in place in the wellbore to provide a path for fluid flow from the surface, through the interior of the drillpipe landing string to the shoe of the liner casing string while blocking fluid flow through the diverter ports to the annulus. The method further includes carrying out cementing operations, which include connecting the rig's top drive (possibly including a cement plug launching head) to the top of the drillpipe landing string; pumping drilling fluid from the top drive through the drillpipe landing string and liner casing string; launching a first cement plug and pumping cement through the drillpipe landing string and liner casing string; and possibly launching a second cement plug and pumping drilling fluid to displace cement into the annulus surrounding the liner casing string.

In concert with opening the flow restrictor, the diverter is shifted to closed position so as to block the fluid passage from the interior of the drillpipe landing string to the annulus. Once the flow restrictor has been opened and the diverter ports have been closed, fluid can be pumped from the surface (i.e. drilling rig fluid pumping system) down through the landing string, into and down through the liner casing string and out of the float shoe at the bottom of the liner string into the open wellbore.

Once fluid circulation has been established, cementing darts are launched, followed by cement, which are pumped down through the landing string until the dart mates with a cement plug that is prepositioned just below the casing or liner hanger and within the top of the liner casing string. Once the dart mates with the cement plug, the dart and plug assembly move downhole in unison and are followed by the cement then top dart and plug. Pumping continues according to normal cementing procedures until the cement is properly positioned in the annulus between the exterior of the liner string and the open wellbore beneath the previously run string of casing.

One embodiment of a method for a handling system for wellbore tubulars may provide steps such as (a) assemble the liner casing string (beginning with the casing guide shoe and auto-fill float collar) into the desired length, (b) make up liner hanger including the casing or liner hanger running tool to the top of the liner casing string, (c) crossover (30) to drill pipe landing string above the casing or liner hanger running tool, then make up the diverter assembly (with ports in the open position) at a distance above the liner hanger running tool, (d) continue running the liner casing string into the wellbore by progressively lengthening the drillpipe landing string, (e) at some distance above the diverter, install the flow restrictor (in closed state in order to block off the flow path up the interior of the drill pipe) (f) continue running the strings into the wellbore and allow displaced wellbore fluid to escape from the interior of the liner string to the annulus above the liner hanger via the open ports of the diverter when the casing string is being lowered downhole, (g) land out the liner casing or liner hanger in the previously run casing string so as to position the liner casing in the wellbore at the desired depth, (h) establish a connection/make-up between the top of the drillpipe landing string and the rig's top drive, (i) actuate the flow restrictor, moving the flow restrictor to the open position with a full-open ID so as to not obstruct drillpipe darts or balls that are utilized when conventional sub-surface cementing operations commence, (j) close or actuate diverter to prevent fluid from passing into or out of the liner casing or landing string via the diverter, (k) release or actuate auto-fill float collar (and shoe if required) to prevent fluid from passing into the casing from the wellbore, (1) conduct conventional sub-surface cementing operations, check float equipment for proper function and release running tool from the system.

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

FIG. 1 illustrates the system for running liner casing into MPD wells according to an embodiment. The system includes liner casing string (13) having auto-fill float equipment (14) connected at the bottom end. Auto-fill float equipment includes auto-fill float collar and casing guide shoe. A liner hanger (12) including liner hanger running tool (22) is attached at the top of the liner casing string (13). A crossover (30) to drill pipe landing string (11) is attached above the casing or liner hanger running tool (22), then a diverter assembly (18) is attached above the crossover (30) to drill pipe landing string. When in an open position, the diverter allows fluid flow up the interior of the tool as well as laterally through the diverter ports to the annulus, providing two flow paths for fluid being displaced during casing or liner running operations. The diverter can be actuated into a closed position, wherein the ports which flow to the annulus are blocked and the fluid can only flow up the interior of the tool. Above the diverter assembly (18), a flow restrictor (21) is installed in the drillpipe landing string (11). The drillpipe landing string (11) can be connected to a top drive (10) or any top drive tool e.g. fluid circulating tool, cement head, cement plug launching head etc. A rotating control device (RCD) (23) seals off annulus between outside diameter of tubular string (11) and the inside diameter of wellbore or previously run casing (15) to create closed loop environment and enables wellbore pressure management. The RCD (23) is connected to the drilling fluids control equipment on the rig via a surface backpressure line (19) that provides fluid which applies pressure to the system while the return line (20) to the MPD choke allows fluid to be removed from the well under controlled pressure.

Figure 2:
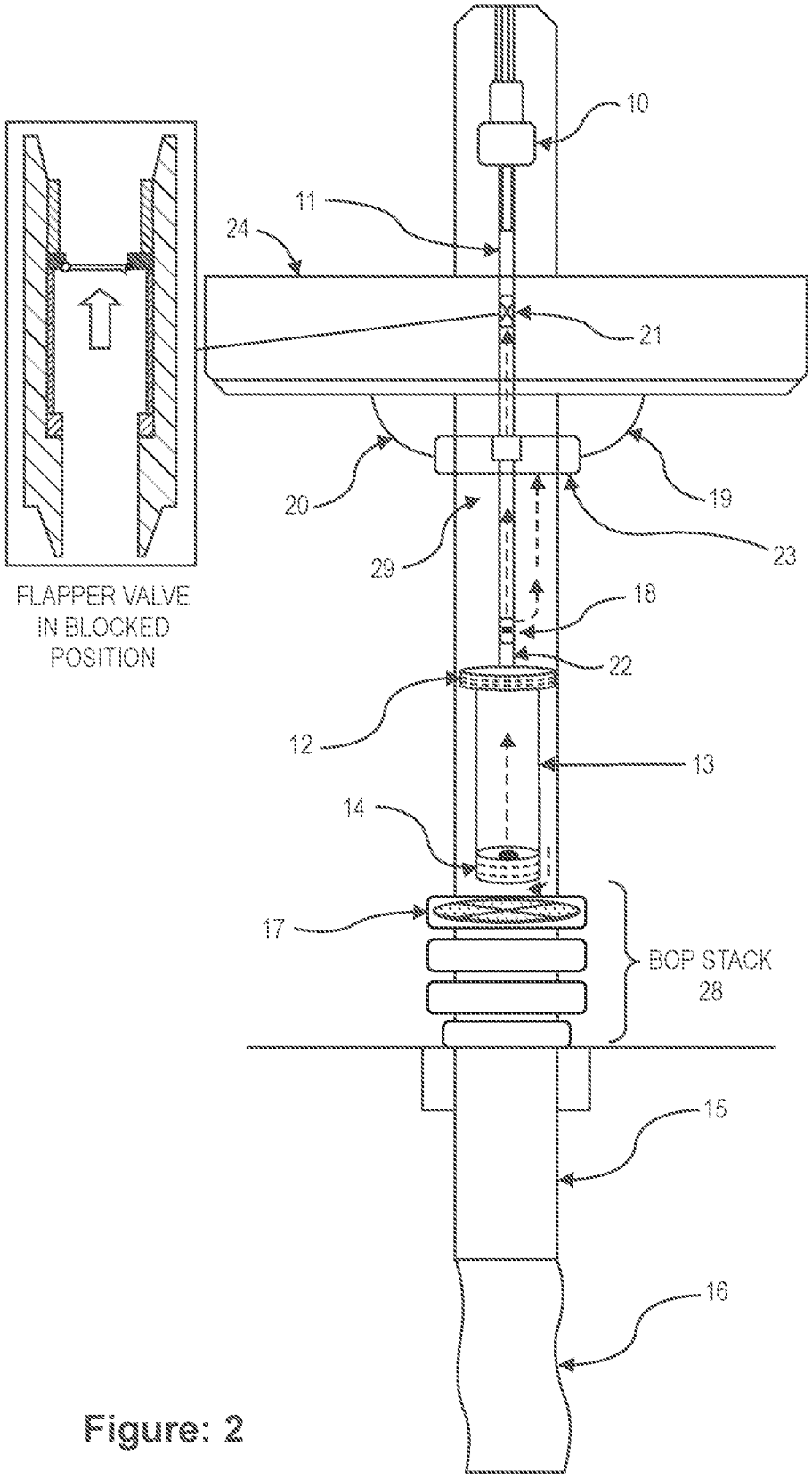
FIG. 2 illustrates stage 1 of liner casing string running operation according to an embodiment.

FIG. 2-FIG. 5 show several stages of running the liner casing (13) in the MPD wellbore. In FIG. 2, stage one of running the string in wellbore is illustrated where the Blind Shear Rams (BSRs) (17) of a blowout preventer (BOP) stack (28) are closed as the liner casing (13) has not yet crossed the BOP (28). While lowering combined strings (11) and (13), the auto-fill float equipment (14) allows the displaced fluid to flow into and through interior of the liner casing (13). The diverter assembly (18) is kept in an open position to permit the fluid flow from inside diameter of drillpipe landing string (11) to the annulus (29) between outer diameter of the drillpipe landing string (11) and inner diameter of wellbore or previously run casing string (15). The flow restrictor (21) is kept in a closed position so that the upward flow of fluid through interior of drillpipe landing string (11) is blocked.

The flow of fluid in stage one is shown in FIG. 2 using arrows. The displaced fluid enters at the bottom of liner casing (13) through the auto-fill float equipment (14), flows up inside and through the liner casing (13), liner hanger (12) and liner hanger running tool (22) and exits to the annulus 29 between drillpipe landing string (11) and ID of wellbore or previously run casing (15). The diverter assembly (18), when in the open position allows fluid to flow up the interior of the diverter assembly (18) and in turn through the interior of drillpipe landing string (11). However, as the flow restrictor (21) is in the closed position, the fluid flow is obstructed and is prevented from reaching the rig floor (24).

Figure 3:
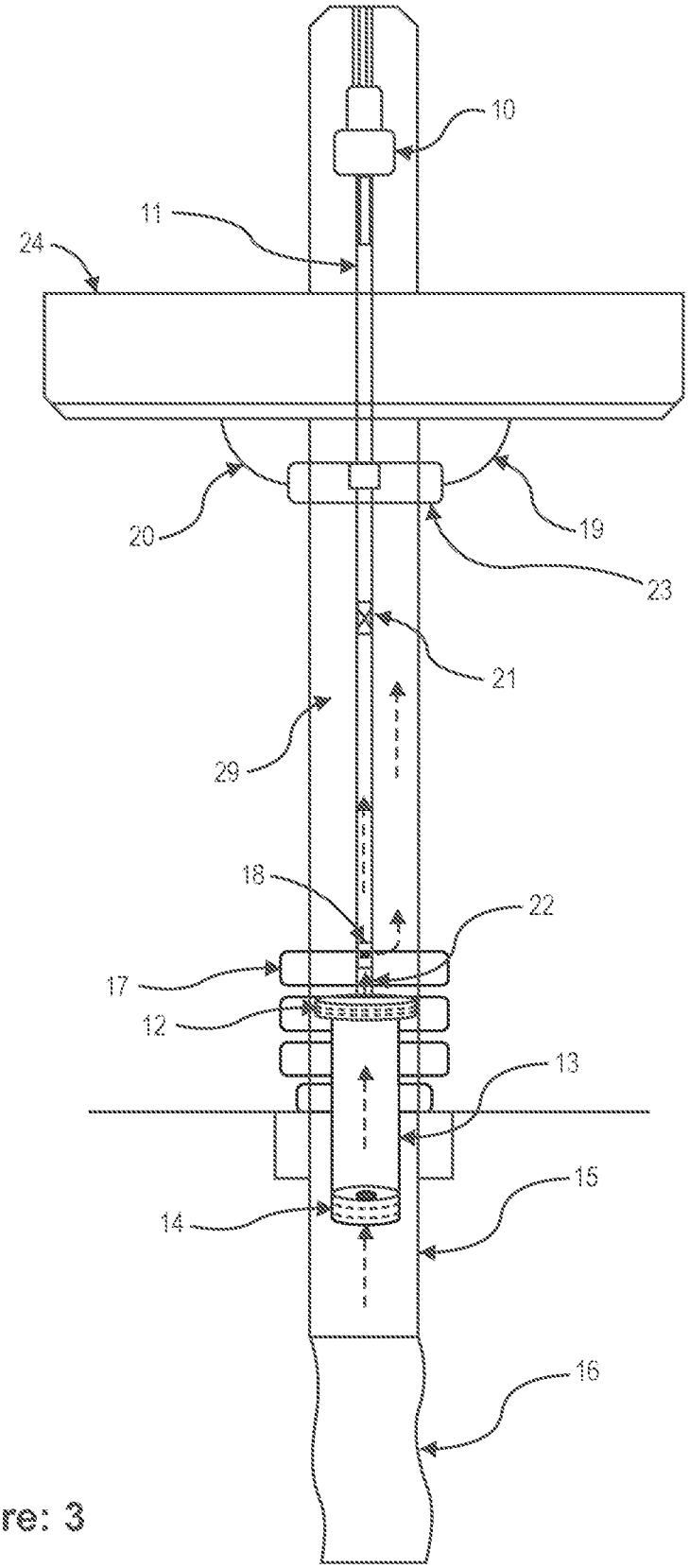
FIG. 3 illustrates stage 2 of liner casing string running operation according to an embodiment.

FIG. 3 illustrates a second stage where the RCD (23) is activated in order to create a closed-loop environment by sealing around the drillpipe to seal off the annulus between the drillpipe and the ID of the wellbore or previously run casing at the RCD elevation, the Blind Shear Rams (17) are opened, and the liner casing (13) is lowered further. The flow restrictor (21) prevents downhole back pressure from traveling to rig floor (24). The diverter assembly (18) (in the open position) and the auto-fill float equipment (14) allow surge pressure on formation (16) to be reduced.

Figure 4:
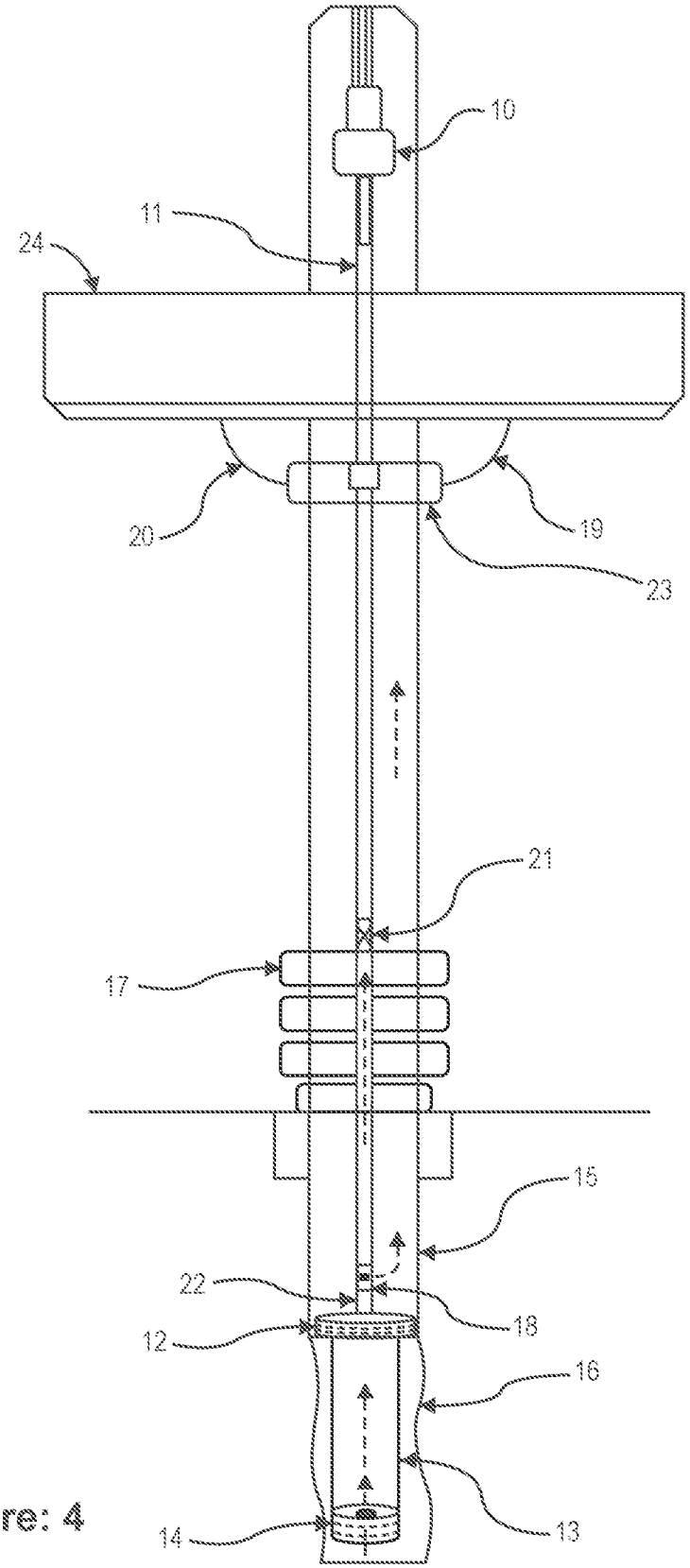
FIG. 4 illustrates stage 3 of liner casing string running operation according an embodiment.

In FIG. 4, a third stage is illustrated where the liner casing (13) is run to the depth at which the casing is to be cemented into place within the wellbore. The auto-fill float equipment (14) which is in a non-converted position allows, allows displaced fluid to flow through the liner casing (13) instead of forcing the fluid through the small annulus between liner casing (13) and the formation or previously run casing (15). The diverter assembly (18) (in the open position) allows fluid to exit the string and into the annulus (29) between drillpipe landing string (11) and the formation or previously run casing (15) above the liner hanger when flow restrictor (21) in the drillpipe landing string (11) restricts the upward flow of fluid to the rig floor (24).

Figure 5:
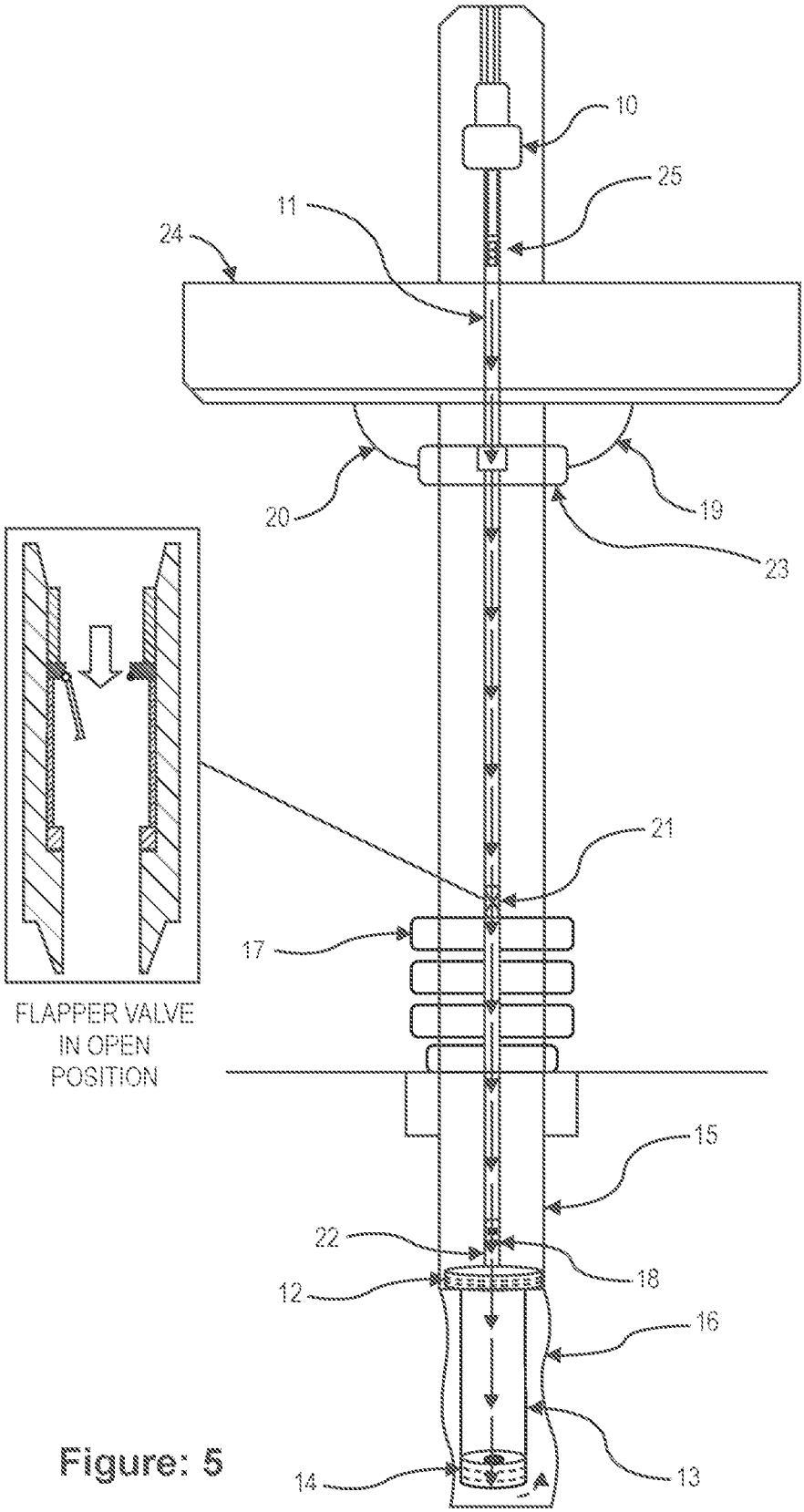
FIG. 5 illustrates stage 4 of liner casing string running operation according to an embodiment.

FIG. 5 illustrates a fourth stage in which the liner casing (13) is landed out in the wellbore at the desired depth in the previously run casing (15) and a connection is established between top of drillpipe landing string and rig's top drive. The flow restrictor (21) is actuated or opened to fully-open the passage through the drillpipe landing string (11) so as to permit deployment therethrough of drillpipe darts or balls that are utilized when conventional sub-surface cementing operations commence. The diverter assembly (18) is closed or actuated to prevent fluid from passing into or out of diverter ports and thus blocking fluid communication between interior of string and annulus. The auto-fill float equipment (14) can be converted to actuate a flapper valve type device (not shown) that serves as check valve during cementing operations by not allowing fluid pressure communication and flow up the interior of the liner casing string (13). The typical manner in which autofill float collars and shoes are converted consists dropping a ball or dart from the surface into the interior of the landing string and pumping fluid to motivate the ball or dart down through the drillpipe landing string and casing string until the ball or dart lands in a seat within the float collar or shoe. The seat is a feature of a components in the auto-fill float equipment that mechanically shifts once the ball or dart lands in the seat and blocks the interior passage within through the shoe or collar. Once this component is shifted a spring loaded flapper valve is free to close thus causing the float equipment to act as a check valve.

Figure 6:
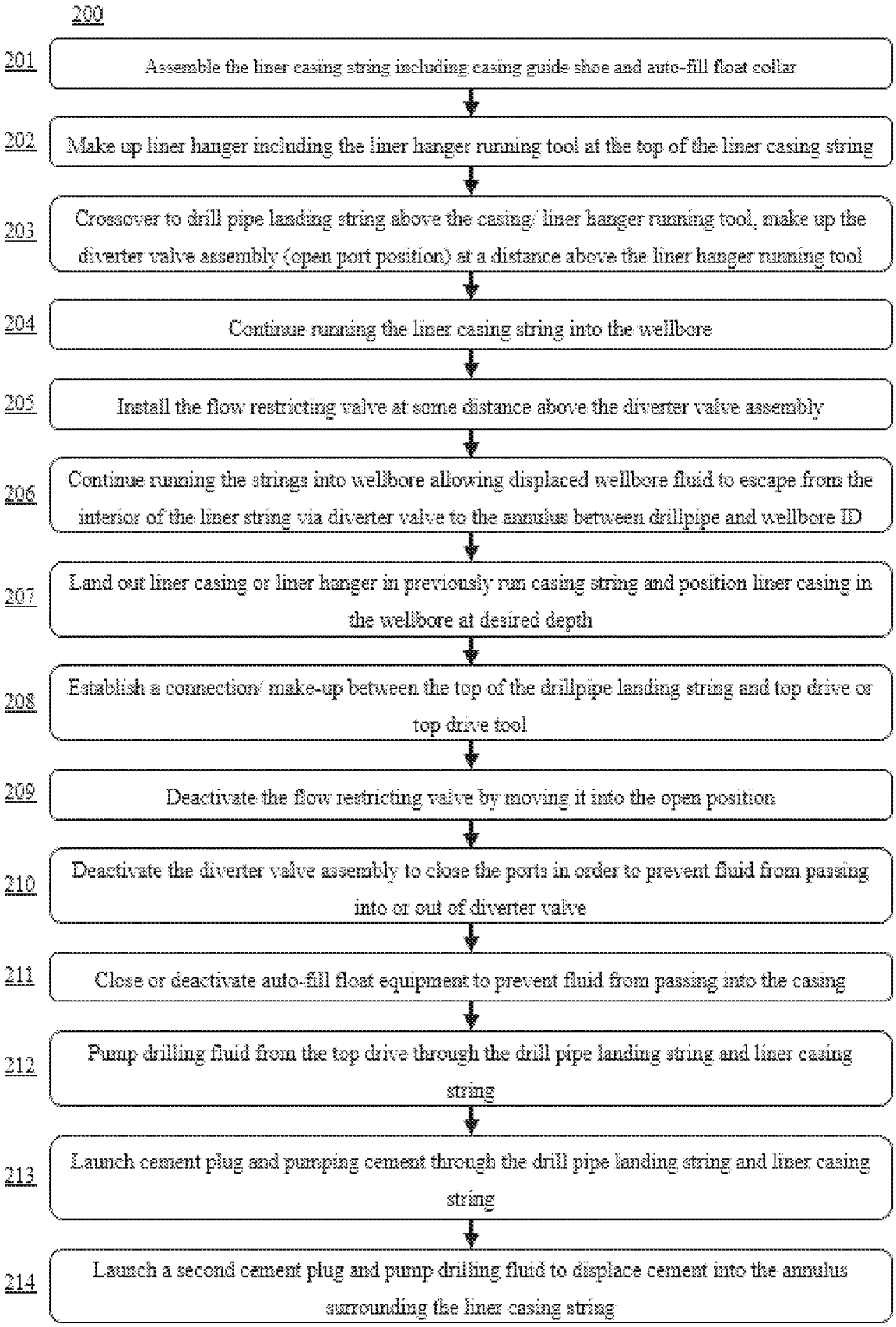
FIG. 6 illustrates a flowchart of a method for controlling surge pressure when installing liner casing strings into a wellbore that is drilled using managed pressure drilling techniques and systems according to an embodiment.
Figure 7A:
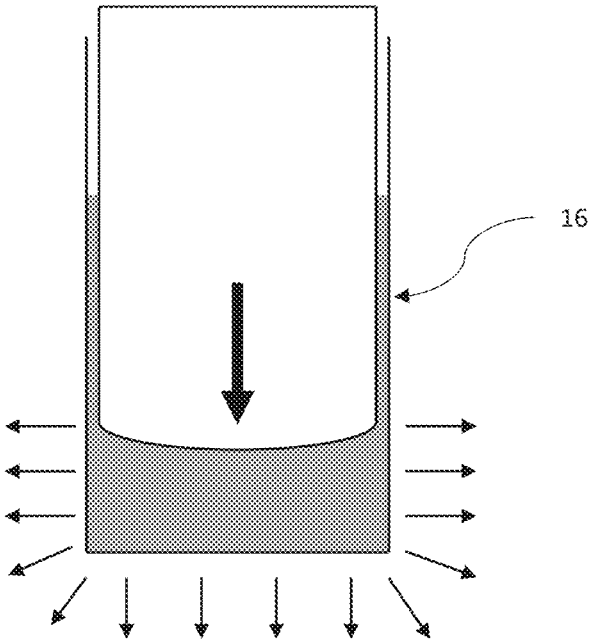
FIG. 7A illustrates the piston effect created on formation due to smaller annular clearance without the use of auto-fill float collar and guide shoe.
Figure 7B:
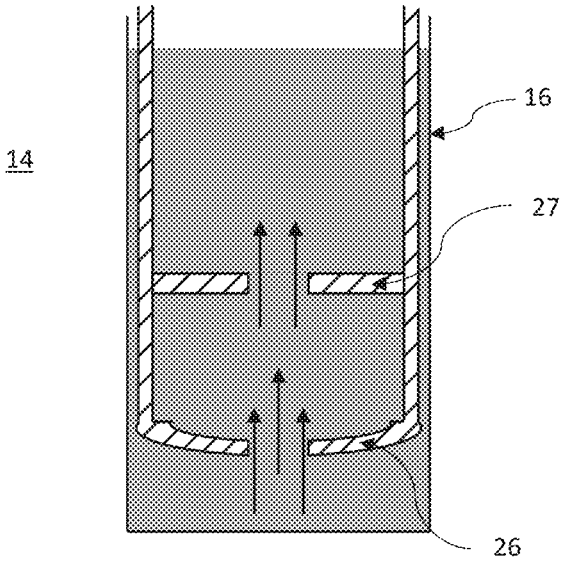
FIG. 7B illustrates use of auto-fill float collar and guide shoe to provide alternate path for displaced fluid flow in order to reduce surge pressure exerted on formation.

FIG. 6 illustrates a flowchart of a method (200) for controlling surge pressure when installing liner casing (13) into a wellbore that is drilled using managed pressure drilling techniques and systems, according to an embodiment.

The method (200) may begin by assembling liner casing string (13) into the desired length with casing guide shoe and auto-fill float collar attached at the bottom end of liner casing, as at 201. The method may further include making up (e.g., connecting) the liner hanger (12) including the casing or liner hanger running tool (22) to the top of the liner casing string (13), as at 202. The next step may be to connect the drill pipe landing string (11) to the casing or liner hanger running tool (22), then make up diverter assembly (18) (with ports in the open position) at a distance above the liner hanger running tool (22), as at 203. The ports of diverter assembly (18) are purposefully kept in open position. The liner casing string (13) is run into the wellbore by progressively lengthening the drillpipe landing string (11), as at 204.

The method (200) may further include installing the flow restrictor (21) above the diverter assembly (18), as at 205. The flow restrictor (21) is kept in the closed position to block the interior passage of drillpipe landing string (11). The strings 11 and 13 are further run into the wellbore, as at 206. While lowering the combined strings 11 and 13, the displaced wellbore fluid enters the ID of liner casing strings (13) and exits through open ports of diverter assembly (18) into the annulus 29 between OD of drillpipe landing string (11) and ID of previously run casing (15). The closed position of flow restrictor (21) blocks upward flow through ID of drillpipe landing string (11) and thus prevents fluid from reaching rig floor.

The method (200) may further include landing out the liner casing (13) or liner hanger (12) in previously run casing string (15) and positioning liner casing (13) in the wellbore at desired depth, as at 207. Now that the liner casing (13) is lowered at its desired location in the wellbore, the drillpipe landing string (11) is now connected to top drive (10). The flow restrictor (21) may be actuated by moving to the open position so as to fully open interior passage of drillpipe landing string (11), as at 209. The drillpipe pump down release tools (25) such as darts, balls, etc. that are utilized in the course of performing conventional sub-surface cementing operation can commence travel through drillpipe ID without any obstruction. The diverter assembly (18) is actuated to close the ports in order to prevent fluid from passing into or out of diverter (18) and thus blocking the fluid flow to annulus, as at 210. The auto-fill float collar (and shoe if required) is closed or actuated to prevent fluid from passing into the casing, as at 211.

The drilling fluid can be pumped down from top drive (10) through drillpipe landing string (11) and liner casing string (12), as at 212. Further, a first cement plug is launched, and cement is pumped through drillpipe landing string (11) and liner casing string (13), as at 213. Now a second cement plug can be launched, and drilling fluid is pumped to displace cement into the annulus surrounding liner casing string (13), as at 214.

As used herein, the terms "in" and "out", "inside" and "outside", "interior" and "exterior", "upward" and "downward", "above" and "below", "uphole" and "downhole"; and other like terms as used herein refer to relative positions to one another and are not intended to denote a particular direction or spatial orientation.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising."

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A system for controlling surge pressure, assembled onto a liner casing string and a drillpipe landing string to be deployed into an oil or gas wellbore that is being drilled using a managed pressure drilling technique, the system comprising:

auto-fill float equipment coupled to a lower end of the liner casing string and configured to allow fluid flow from the wellbore into the liner casing string as the liner casing string is lowered;

a drillpipe diverter attached to the drillpipe landing string and comprising ports that, when open, provide a fluid flow path between an interior of the drillpipe landing string and an annulus defined between the drillpipe landing string and the wellbore; and a drillpipe flow restrictor comprising a drillpipe sub containing a flapper valve that is configured to block flow from a bottom side of the valve to a top side of the valve while allowing flow from the top side of the valve to the bottom side of the valve, wherein the drillpipe flow restrictor is attached to the drillpipe landing string above the diverter and configured to block the flow path from a to the top of the drill pipe landing string while allowing fluid in the bottom of the wellbore to be displaced up an interior of the liner casing string, out through the ports of the diverter, and into the annulus defined between the drillpipe landing string and the wellbore above a liner hanger, wherein the drillpipe diverter is convertible to block flow through the ports of the diverter into the annulus; and wherein the auto-fill float equipment is convertible to block fluid flow path from the wellbore into the liner casing string, while allowing fluid to flow from the liner casing string into the wellbore.

2. A method of controlling surge pressure when installing a liner casing string into a wellbore that is drilled using a managed pressure drilling technique, the method comprising;

attaching auto-fill float equipment to a lower end of the liner casing string;

assembling the liner casing string;

connecting a liner hanger to a top end of the liner casing string;

connecting a drill pipe landing string above the liner hanger via a crossover connection wherein the drillpipe landing string includes a diverter, with diverter ports open located in a lower portion of the string and a flow restrictor in a closed position in the drill pipe landing string, above the diverter;

wherein the drillpipe flow restrictor comprises a drillpipe sub containing a flapper valve that is oriented to block flow from a bottom side of the valve to a top side of the valve while allowing flow from the top side of the valve to the bottom side of the valve;

lowering the liner casing string into the well to a desired depth, while allowing displaced fluid to flow up through the auto-fill float equipment through an interior of the liner casing string and through the ports of the diverter to an annulus between an exterior of the drillpipe landing string and the wellbore above the liner hanger, wherein fluid flow up the interior of the drillpipe landing string above the diverter is blocked by the flow restrictor;

establishing a connection between the drillpipe landing string and a top drive;

actuating the flow restrictor, into an open position, allowing fluid to flow from the top drive through the drill pipe landing string and the liner casing string;

actuating the diverter, to close the diverter ports thereby allowing fluid to be pumped from the top drive through the drillpipe landing string and liner casing string, wherein fluid is prevented from flowing out of the diverter ports;

actuating the auto-fill float equipment to prevent fluid from flowing from the wellbore into the liner casing string;

pumping drilling fluid from the top drive through the drillpipe landing string and liner casing string;

cementing the liner casing string in place wherein cementing includes launching a first ball or dart to release a cement plug and pumping cement through the drillpipe landing string and liner casing string; and pumping drilling fluid to displace cement into an annulus surrounding the liner casing string.

3. The method of claim 2, further comprising launching a second cement plug between the cement and drilling fluid to displace the cement.

* * * * *